United States Patent [19]

Nakamori et al.

[11] Patent Number: 5,011,731

[45] Date of Patent: Apr. 30, 1991

[54] SHEET MATERIAL

[75] Inventors: Haruka Nakamori; Hiroshi Ito, both of Tokyo, Japan

[73] Assignee: Daiki Co., Ltd., Tokyo, Japan

[21] Appl. No.: 387,514

[22] Filed: Jul. 28, 1989

[30] Foreign Application Priority Data

| | | | |
|---|---|---|---|
| Aug. 2, 1988 | [JP] | Japan | 63-102010[U] |
| Sep. 13, 1988 | [JP] | Japan | 63-227373 |
| Nov. 10, 1988 | [JP] | Japan | 63-282602 |
| Nov. 18, 1988 | [JP] | Japan | 63-292027 |
| Nov. 18, 1988 | [JP] | Japan | 63-292028 |
| Nov. 18, 1988 | [JP] | Japan | 63-292029 |

[51] Int. Cl.[5] ..... D03D 13/00

[52] U.S. Cl. ..... 428/222; 51/432; 51/434; 51/454; 51/483; 51/490; 427/411; 428/221; 428/224; 428/284; 428/297; 428/486; 428/537.1; 428/920

[58] Field of Search ..... 428/221, 224, 284, 222, 428/486, 920, 297, 537; 5/432, 434, 459, 483, 490; 427/411; 252/601, 607

[56] References Cited

U.S. PATENT DOCUMENTS 3,888,711 6/1975 Breitner ..... 428/221

*Primary Examiner*—James J. Bell

*Attorney, Agent, or Firm*—Bierman and Muserlian

[57] ABSTRACT

The sheet material of the present invention comprises a base sheet which is formed of at least one sheet of paper or non-woven fabric sheet and a plural number of threads embedded within the base sheet, interposed between the sheets of paper or non-woven fabric sheets or bonded to the surface of the base sheet. Accordingly, the sheet material has a high strength even when the base sheet is formed of inexpensive and disposable paper. The base sheet can be impregnated with a flame retardant agent such as an ammonium phosphate compound, nitrogen-containing compound and sulfur-containing compound to be imparted with good flame retardancy. The sheet material is provided with certain indications such as commerical advertisements so that articles made from the inventive sheet material are commerically advantageous especially when guests of hotels and the like are allowed to take out the articles.

13 Claims, 4 Drawing Sheets

SHEET MATERIAL

FIELD OF INDUSTRIAL APPLICATION

The present invention relates to a sheet material particularly suitable for use as a material of a bedding sheet, covering case of a bedquilt and other bedding goods.

PRIOR ART TECHNOLOGY

Attempts have been made hitherto to utilize paper or a non-woven fabric sheet as a material of various kinds of bedding goods and furniture accessories such as a covering case of a bedquilt 10, collar pad of a bedquilt 11, bedding sheet 12 and pillowcase 13 illustrated in FIG. 8, toweling spread 14 illustrated in FIG. 9 and headrest cover 15 of chairs and seats used in transportation vehicles, vessels, aircrafts, movie theaters, drama theaters and the like illustrated in FIG. 10.

DISCLOSURE OF THE INVENTION

The use of paper and the like material in the above mentioned applications in the prior art, however, has a problem from the standpoint of practical usability in respect of the relatively low mechanical strength of the sheet material such as paper because it is usual to use a cheap or inexpensive material to be disposable in addition to the problem that such a material is highly combustible readily to catch fire.

In addition, conventional articles made of such a sheet material are not always advantageous in respect of the desirable advertising effect in the absence of any commercial indication when, in particular, such articles are used in hotels and the like where the guests are allowed to take out such bedding goods.

Moreover, conventional sheet materials of paper or non-woven fabric have a disadvantage in the poor permeability of moisture so that, when the sheet material is used as a bedding sheet for an aged person confined to bed all day long, the underlying bedding mat becomes sometimes musty.

The present invention accordingly proposes a solution of the above mentioned problems and has an object to provide a novel sheet material having a practically satisfactory strength as a material of bedding goods even when the base material thereof is an inexpensive disposable material such as paper.

Further, the present invention has another object to provide a novel sheet material having high flame retardancy even when the base material thereof is an inexpensive disposable material such as paper so that the bedding goods prepared therefrom may have no problems in safety against fire.

In addition, the present invention has still another object to provide bedding goods having an advantage of susceptibility of any commercial indications to exhibit an effect of advertisement.

Moreover, the invention has an object to provide a sheet material having good permeability of moisture so that, when the material is used as a bedding sheet, the underlying bedding mat is freed from the problem of mustiness.

The sheet material of the present invention comprises a base sheet which is formed of at least one sheet of paper or non-woven fabric sheet, and a plurality of threads embedded within the base sheet, interposed between the base sheets when two or more base sheets are integrated or bonded to the surface of the base sheet. Having the above mentioned structure, the inventive sheet material has a high mechanical strength even when the base sheet is made of inexpensive and disposable paper and is agreeable to the touch of skin with good absorptivity of perspiration. The inventive sheet material is also advantageous in respect of heat insulation and warmness and the patient lying on the bedding sheet made of the inventive sheet material is freed from the pain of bedsore.

Further, the inventive sheet material may have high flame retardancy when the base sheet, which is formed of paper or non-woven fabric, is impregnated with a flame retardant agent such as ammonium phosphate compounds, nitrogen-containing compounds and sulfur-containing compounds.

The sheet material of the present invention namely comprises a base sheet, which is formed of at least one sheet of paper or non-woven fabric sheet, and a plurality of threads embedded within the base sheet, interposed between the sheets or bonded to the surface of the base sheet, the threads alone being impregnated with a flame retardant agent selected from the group consisting of ammonium phosphate compounds, nitrogen-containing compounds and sulfur-containing compounds.

According to the present invention, furthermore, the threads are replaced with wires of hardly combustible metal.

By virtue of the above described constitution of the inventive sheet material, it is highly flame retardant to prevent spreading of fire at the metal wires even when the sheet material has caught fire in addition to the effect of reinforcement thereby.

Besides, no damage by chemicals is caused even when the sheet material is directly contacted with human skin because the threads alone are impregnated with a flame retardant agent or the threads are replaced with hardly combustible metal wires without using any flame retardant agent.

Additionally, an advantage is obtained with articles made from the inventive sheet material, which guests of hotels and the like are allowed to take out, in respect of the advertising effect because the inventive sheet material is susceptible to any commercial indications thereon.

Still further, the inventive sheet material may have water-proofness when the sheet is coated on proper portions with a paraffin-based wax or laminate.

As a consequence, a bedding sheet prepared from the inventive sheet material retains high permeability of moisture to prevent the underlying bedding mat from mustiness because the inventive sheet material is imparted with water-proofness on proper portions alone without being coated as a whole with a paraffin-based wax and the like.

As a further advantage, a bedding sheet prepared from the inventive sheet material can be used by folding the marginal portions so as to envelop the underlying bedding mat without the trouble that the bedding sheet sometimes slips down owing to the adequately high friction between the mat and sheet.

To say more, the inventive sheet material is coated on proper portions with a paraffin-based wax or a laminate and provided with a plural number of open pores having permeability to air but resistive against permeation of water due to the surface tension thereof.

When the inventive sheet material is coated on proper portions with a paraffin-based wax and the like, the sheet material still retains permeability to moisture at the open pores so that, when a bedding sheet is prepared from the inventive sheet material, the underlying bedding mat is freed from the problem of mustiness.

Even when the inventive sheet material as a whole is coated with a paraffin-based wax or a laminate, the sheet material can still retain permeability to moisture as being provided with a plural number of open pores having permeability to air but resistive against permeation of water with surface tension.

The inventive sheet material coated as a whole with a paraffin-based wax and the like is quite satisfactory as a bedding sheet for an aged person confined to bed all day long because the sheet has permeability to moisture by virtue of the open pores to prevent mustiness of the underlying mat and infiltration of the excrements from the patient lying on the bed.

Figure 8:
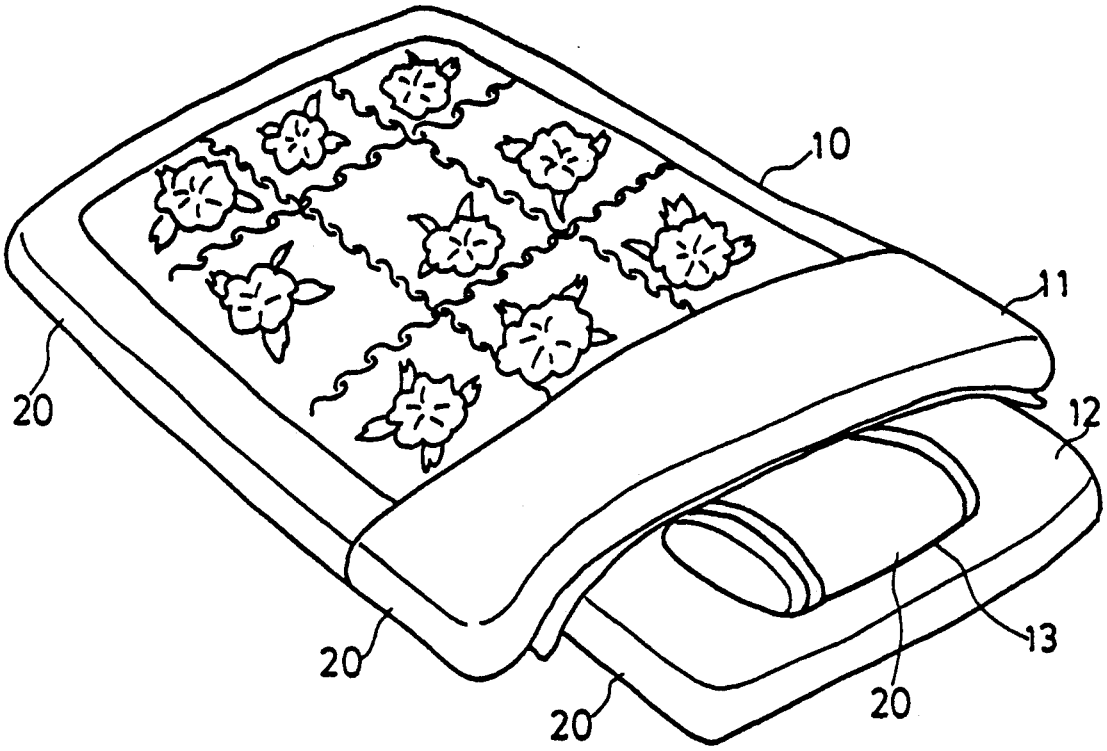
Figure 9:
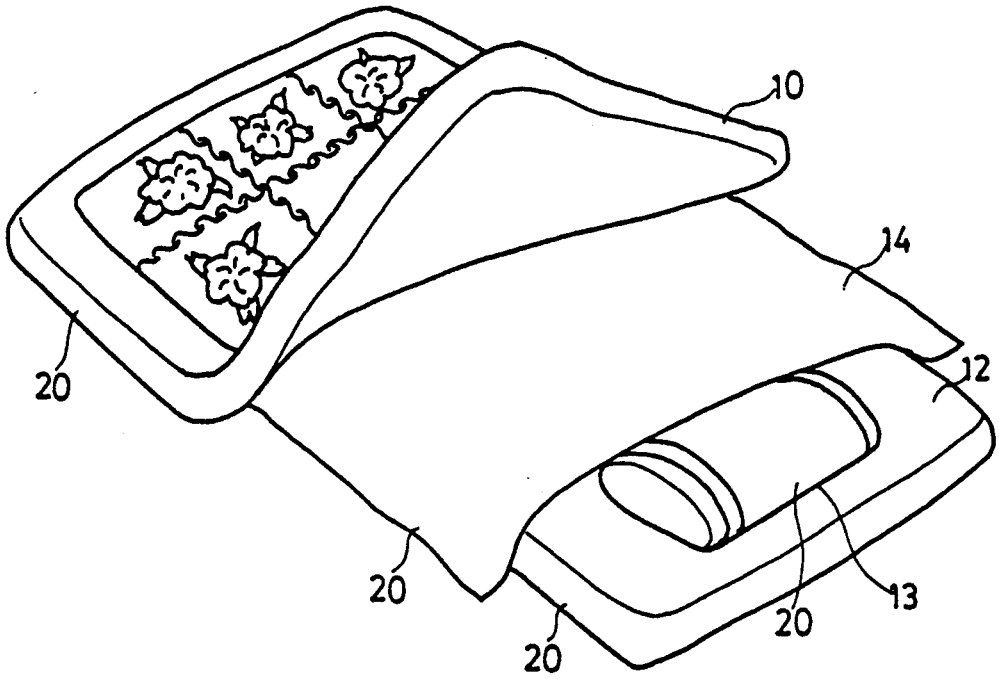
Figure 10:
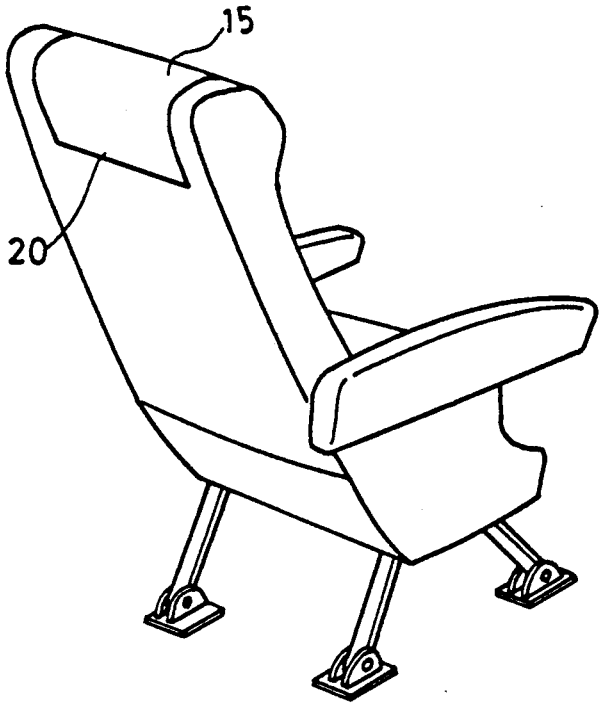

FIGS. 8, 9 and 10 each illustrate a different application of the inventive sheet material.

EXAMPLE

In the following, the sheet material of the present invention is described in more detail by way of examples with reference to the accompanying drawing.

Figure 3:
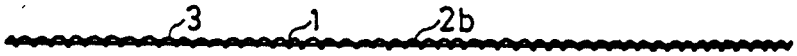
FIG. 3 is also a cross sectional view of the same sheet material as viewed along the arrows B—B in FIG. 1.
Figure 1:
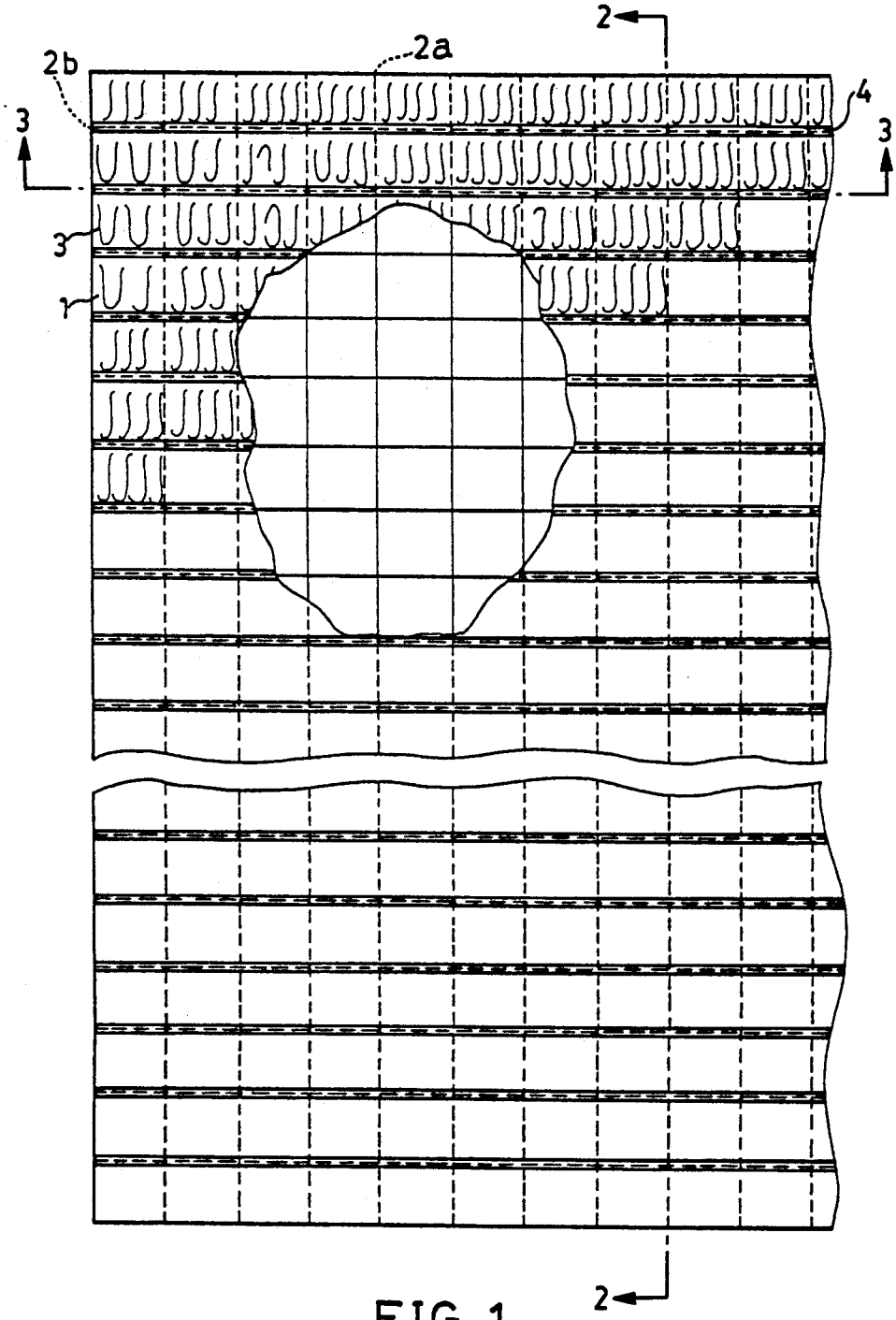
FIG. 1 is a plan view of the inventive sheet material as partly cut open to show the cross section, which is an embodiment of the present invention.
Figure 2:
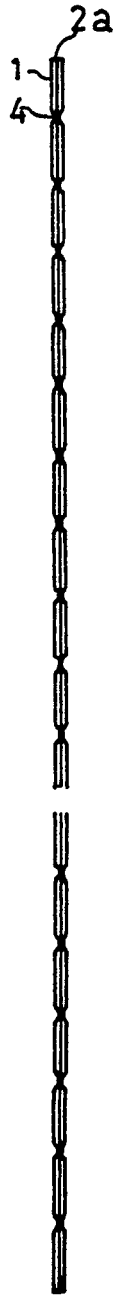
FIG. 2 is a cross sectional view of the same sheet material as viewed along the arrows A—A in FIG. 1.

FIG. 1 illustrates a plan view of the sheet material of the present invention including a partial cross section. FIG. 2 illustrates a cross section of the same sheet material as viewed along the arrows A—A in FIG. 1. FIG. 3 also illustrates a cross sectional view of the same sheet material as viewed along the arrows B—B in FIG. 1.

Figure 5:
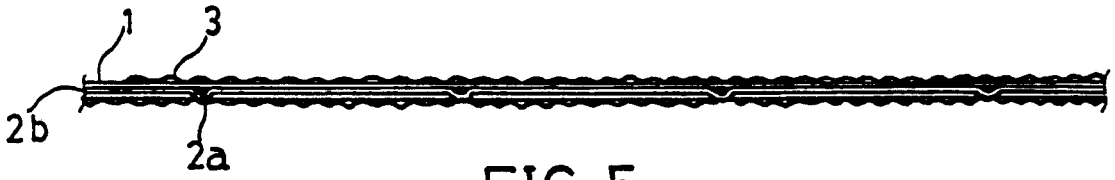
FIG. 5 is an enlargement of FIG. 3.
Figure 4:
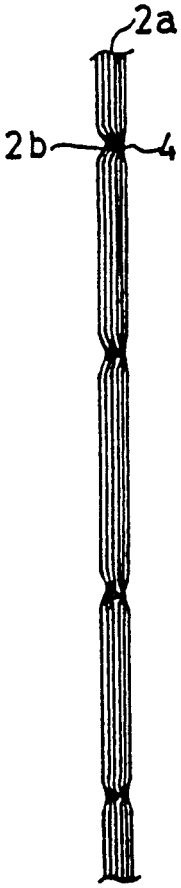
FIG. 4 is an enlargement of FIG. 2.

Further, FIG. 4 is an enlargement of FIG. 2 and FIG. 5 is an enlargement of FIG. 3. As is illustrated in these figures, the inventive sheet material is composed of a base sheet 1 which in turn is formed of a plurality of plies of sheets of paper or non-woven fabric sheets and a plurality of threads 2a, 2b interposed between the sheets of paper or non-woven fabric running approximately in parallel with each other.

It is optional that these threads 2a, 2b are bonded to one or both of the surfaces of the base sheet 1.

It is further optional that the threads 2a, 2b are embedded within the sheet 1 of paper or non-woven fabric sheet.

Although each of the inventive sheet materials illustrated in the figures have two groups of threads 2a, 2b including, on one hand, those running in the lengthwise direction of the sheet 1 something like warps in a woven cloth and, on the other hand, those running in the transverse direction something like woofs in a woven cloth, it is optional that the inventive sheet material has threads all running in one and the same direction.

It is not essential that, notwithstanding the illustration in the figures, each of the woofs 2b is press-bonded to the plies of the base sheet 1 along the line constriction 4.

When the base sheet 1 is caused to shrink, wrinkles 3 are formed in the areas surrounded by the threads 2a, 2b.

When adequately formed, the wrinkles 3 exhibit a cushioning effect to improve the feeling of touch of human skin in addition to the advantage of enhanced absorptivity of perspiration and heat insulation so as to be effective in preventing a bedsore of patients prolongedly lying on the bedding sheet prepared from such a wrinkled sheet material of the invention.

Figure 6:
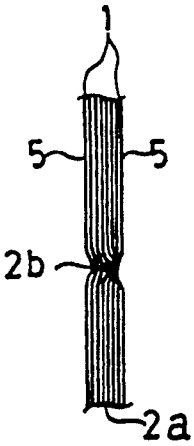
FIG. 6 illustrates a partial side view of another embodiment of the inventive sheet material.

As is illustrated in FIG. 6 by a cross sectional view, the inventive sheet material can be provided with a cloth 5 of a suitable synthetic fiber and the like bonded adhesively to one or both of the surfaces of the base sheet 1.

Figure 7:
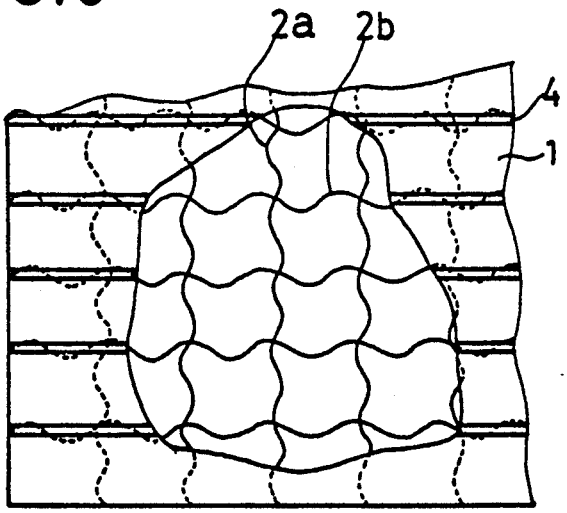
FIG. 7 illustrates a partial side view of still another embodiment of the inventive sheet material.

As in the embodiment illustrated in FIG. 7, it is not always essential that the threads 2a, 2b run each in a straight line but each thread runs in a curved disposition without particular limitations.

As is mentioned before, it is preferable that the base sheet 1 in each of the above described embodiments is impregnated with a flame retardant agent selected from the group consisting of ammonium phosphate compounds, nitrogen-containing compounds and sulfur-containing compounds.

Examples of the flame retardant agent include, for example, organic high polymers containing phosphorus, polymerized organic phosphorus compounds, condensed phosphate esters, organic phosphoric acid compounds, ignorganic phosphoric acid compounds, organic nitrogen-containing sulfur compounds, organic nitrogen-containing phosphorus compounds, phosphorus-boron compounds, phosphorus-nitrogen compounds and the like.

It is optional that the base sheet 1 is impregnated with a perfume and the like. It is also optional of course that the base sheet 1 is colored in any desired color tone.

Alternatively, the threads 2a, 2b alone are impregnated with a flame retardant agent selected from the group consisting of ammonium phosphate compounds, nitrogen-containing compounds and sulfur-containing compounds.

The reinforcing threads 2a, 2b can be replaced with hardly combustible metal wires. When the inventive sheet material has such metal wires, good flame retardancy can be obtained even by omitting the treatment for impregnating the sheet material with a flame retardant agent mentioned above.

It is optional according to need that certain indications 20 such as commercial advertisement and the like are provided on the surface of the sheet 1 which forms various kinds of bedding goods and furniture accessories such as the covering case of a bedquilt 10, collar pad 11 of a bedquilt, bedding sheet 12 and pillowcase 13 illustrated in FIG. 8, toweling spread 14 illustrated in FIG. 9 and headrest cover 15 of chairs and seats illustrated in FIG. 10.

The sheet material of the invention can be coated at appropriate portions with a paraffin-based wax or laminate. Thus, the inventive sheet material is imparted with water-proofness with the paraffin-based wax or laminate.

When a sheet material of the invention imparted portionwise with water-proofness is used as a bedding sheet, an advantage is obtained that, because the sheet material as a whole is not coated with a paraffin-based wax and the like, the sheet retains permeability to moisture so that the underlying bedding mat is freed from the trouble of mustiness and that, when the marginal portions of the sheet spread over the bedding mat are folded back so as to envelop the bedding mat, the sheet is freed from the trouble of slipping down owing to the friction with the bedding mat.

Further, it is optional that the inventive sheet material coated at portions with a paraffin-based wax or laminate is provided with a plurality of open pores having permeability to air but resistive against permeation of water with surface tension. By this means, a further enhanced advantage is obtained that, when a sheet material of the invention coated at portions with a paraffin-based wax and the like is used as a bedding sheet, the sheet material is imparted with further increased permeability to moisture so that the trouble of mustiness is further decreased in the underlying bedding mat.

It is of course optional that the sheet material of the invention as a whole is coated with a paraffin-based wax or laminate while it is provided with a plural number of open pores having permeability to air but resistive against permeation of water with surface tension.

Such a sheet material of the invention coated as a whole with a paraffin-based wax and the like still retains permeability to moisture and can be used advantageously as a bedding sheet for an aged person confined to bed all day long because the sheet is resistive against infiltration of the excrements by the patient without causing a trouble of mustiness in the undelying bedding mat.

Though not illustrated in the accompanying drawing, the field of application of the inventive sheet material is not limited to the covering case of bedquilt 10 and the like illustrated in FIGS. 8, 9 and 10 but include all kinds of fabric-made bedding goods and furniture accessories with sleeping bags, tablecloths and the like only as a part of possible examples.

We claim:

1. A sheet material comprising a base sheet formed of at least one sheet of a paper and a plurality of threads embedded within the base sheet, interposed between the sheets of paper or bonded to the surface of the base sheet.

2. The sheet material as claimed in claim 1 wherein the base sheet is impregnated with a flame retardant agent selected from the group consisting of ammonium phosphate compounds, nitrogen-containing compounds and sulfur-containing compounds.

3. A bedding sheet prepared from the sheet material claimed in claim 1.

4. A covering case of a bedquilt prepared from the sheet material claimed in claim 1.

5. A pillow case prepared from the sheet material claimed in claim 1.

6. A headrest cover of a chair or seat prepared from the sheet material claimed in claim 1.

7. A collar pad of a bedquilt prepared from the sheet material claimed in claim 1.

8. A toweling spread prepared from the sheet material claimed in claim 1.

9. The sheet material as claimed in claim 1 in which the threads are impregnated with a flame retardant agent selected from the group consisting of ammonium phosphate compounds, nitrogen-containing compounds and sulfur-containing compounds.

10. An article for bedding or a furniture accessory made of the sheet material claimed in claim 1 on which advertising is exhibited.

11. An article for bedding or a furniture accessory made of the sheet material claimed in claim 1 coated at portions with a paraffin-based wax.

12. The article for bedding or the furniture accessory as claimed in claim 11 which is partially coated with a paraffin-base wax with a plurality of open pores having permeability to air but resistant against permeation of water with surface tension.

13. An article for bedding or a furniture accessory made of the sheet material claimed in claim 1 which is coated as a whole with a paraffin-based wax and provided with a plurality of open pores having permeability to air but resistant against permeation of water with surface tension.

* * * * *